United States Patent [19]

Bäse et al.

[11] 4,339,026

[45] Jul. 13, 1982

[54] APPARATUS FOR DELIVERING CIGARETTES OR THE LIKE FROM A MAKER TO A CONSUMING MACHINE

[75] Inventors: Horst Bäse; Gerhard Tolasch, both of Hamburg; Jürgen Bantien, Hamwarde, all of Fed. Rep. of Germany

[73] Assignee: Hauni-Werke Körber & Co. KG, Hamburg, Fed. Rep. of Germany

[21] Appl. No.: 130,391

[22] Filed: Mar. 14, 1980

Related U.S. Application Data

[63] Continuation of Ser. No. 6,223, Jan. 24, 1979, abandoned, which is a continuation of Ser. No. 804,332, Jun. 7, 1977, abandoned.

[30] Foreign Application Priority Data

Jun. 17, 1976 [DE] Fed. Rep. of Germany ..... 2626157

[51] Int. Cl.[3] ..... B65G 1/00

[52] U.S. Cl. ..... 198/347; 198/358; 198/437

[58] Field of Search ..... 198/347, 356–358, 198/363, 437, 438, 441, 447, 448, 502, 568, 572, 573, 575, 577, 601, 855, 856; 414/294–296; 53/148, 151, 236, 503; 131/280, 282, 283, 909

[56] References Cited

U.S. PATENT DOCUMENTS

| | | | |
|---|---|---|---|
| 2,997,828 | 8/1961 | Ahlbor | 198/347 |
| 3,460,687 | 8/1969 | Bardenhagen | 494/295 |
| 3,782,523 | 1/1974 | Giatti | 198/347 |
| 3,952,854 | 4/1976 | Selonke et al. | 198/601 |
| 4,142,622 | 3/1979 | Seragnoli | 198/347 |

FOREIGN PATENT DOCUMENTS

| | | | |
|---|---|---|---|
| 1957002 | 9/1970 | Fed. Rep. of Germany | 198/575 |
| 2621564 | 12/1976 | Fed. Rep. of Germany | 198/347 |

OTHER PUBLICATIONS

Research Disclosure #132, 4 '75, p. 14.

*Primary Examiner*—Joseph E. Valenza
*Attorney, Agent, or Firm*—Kontler, Grimes & Battersby

[57] ABSTRACT

Apparatus which delivers rod-shaped articles, such as cigarettes or filter rod sections, from a producing machine to a consuming machine has a switching unit whose inlet receives articles from the producing machine, one outlet of which can feed articles to a first transporting unit for admission of articles into a surge bin cooperating with a second transporting unit for delivery of articles to one side of the magazine of the consuming machine, and another outlet of which can feed articles to a third transporting unit for direct delivery of articles to another side of the magazine of the consuming machine. The third transporting unit delivers articles to the magazine when the latter is not filled to capacity, and the first transporting unit delivers articles to the surge bin when the magazine is filled to capacity. The third transporting unit transports articles from the surge bin to the magazine when the inlet of the switching unit receives articles at a rate which does not satisfy the requirements of the consuming machine or when the producing machine is idle. An observation station is defined by a conveyor of the third transporting unit or by a conveyor between the inlet of the switching unit and the producing machine to allow for visual inspection of articles. The second and third transporting units deliver multi-layer streams of articles to the respective sides of the magazine.

10 Claims, 2 Drawing Figures

APPARATUS FOR DELIVERING CIGARETTES OR THE LIKE FROM A MAKER TO A CONSUMING MACHINE

CROSS-REFERENCE TO RELATED CASES

This is a continuation of our copending application Ser. No. 006,223 filed Jan. 24, 1979, now abandoned. The application Ser. No. 006,223 is a continuation of copending application Ser. No. 804,332, filed June 7, 1977, now abandoned.

BACKGROUND OF THE INVENTION

The present invention relates to apparatus for delivering cigarettes, filter rod sections or other rod-shaped articles which constitute or form part of smokers' products from a maker (e.g., a filter rod making machine, a cigarette making machine or a filter tipping machine) to a consuming or processing machine which may constitute a filter tipping machine, a pneumatic sender which delivers rod-shaped articles to the magazine or magazines of one or more further processing machines, or a packing machine. More particularly, the invention relates to improvements in apparatus which comprise a variable-capacity article-storing device or reservoir, especially a surge bin, for temporary storage of articles which are produced while the consuming machine is idle or while the consuming machine is operated at less than full speed so that it cannot accept the entire output of the producing machine.

It was already proposed bo convey rod-shaped articles which are turned out by a producing machine to a consuming machine (e.g., to the magazine of a packing machine for plain or filter tipped cigarettes) along a first path which extends directly from the outlet of the producing machine to the magazine of the consuming machine, or along a second path a portion of which is defined by a surge bin to allow for temporary storage of the surplus. Under normal circumstances, the magazine receives articles along the first path. When the consuming machine is idle or is operated at less than normal speed, the articles are fed into the second path and enter the surge bin to be evacuated from the surge bin and fed to the magazine as soon as the consuming machine is capable to accept articles, when the consuming machine is operated while the producing machine is idle or when the requirements of the consuming machine exceed the output of the producing machine.

OBJECTS AND SUMMARY OF THE INVENTION

An object of the invention is to provide an apparatus which can treat the articles gently to thus insure that the articles reaching the consuming machine satisfy the strictest requirements regarding their quality as well as that the articles cannot or are highly unlikely to lie askew and to thus adversely influence the operation of the apparatus and/or of the consuming machine.

Another object of the invention is to provide an apparatus which allows for immediate inspection of at least some articles during transport from one or more makers to the consuming machine.

A further object of the invention is to provide an apparatus which can be used with equal advantage for delivery of highly sensitive articles (such as plain or filter tipped cigarettes) as well as of filter rod sections and analogous rod-shaped articles which are more resistant to deformation of and/or other damage to their wrappers or fillers.

An additional object of the invention is to provide an apparatus which can be installed between existing makers and consumers or processors of cigarettes or other rod-shaped articles which constitute or form part of smokers' products.

An ancillary object of the invention is to provide novel and improved article transporting units for use in the above outlined apparatus.

Another object of the invention is to provide an apparatus which does not permit articles entering the consuming machine to damage the previously delivered articles and which does not permit previously delivered articles to damage or deface the freshly delivered articles.

A further object of the invention is to provide an apparatus which is less prone to malfunction than heretofore known apparatus.

An additional object of the invention is to provide an apparatus which can store substantial quantities of articles for delivery to the consuming machine in the event of malfunction or stoppage of the maker.

The invention is embodied in an apparatus for delivering streams of cigarettes, filter rod sections or analogous rod-shaped articles from a producing machine (e.g., a cigarette maker or a filter rod maker) to a consuming machine (e.g., a packing machine for cigarettes or a sender which conveys filter rod sections to a filter tipping machine) which includes a magazine having a first side and a second side. The apparatus comprises first advancing means which defines a first path having a first inlet and a first outlet communicating with one side of the magazine in the consuming machine (the first advancing means includes a first transporting unit which defines a first portion of the first path including the first inlet, a second transporting unit which defines a second portion of the first path ending at the first outlet, and a variable-capacity reservoir, preferably a surge bin, which communicates with the first path between the first and second portions and serves to receive articles from the first transporting unit or to feed articles to the second transporting unit), second advancing means including a third transporting unit which defines a second path having a second inlet preferably adjacent to the first inlet and a second outlet communicating with the other side of the magazine in the consuming machine, switching means interposed between the producing machine and the first and second inlets and being operable to direct articles issuing from the producing machine into a selected inlet, means for operating the switching means to direct articles into the first inlet when the ratio of articles supplied by the producing machine to articles removed by the third transporting unit (second advancing means) is above a predetermined value and to direct articles into the second inlet when the aforementioned ratio drops to the predetermined value, and means for varying the volume of the reservoir (i.e., for causing articles to enter the reservoir during operation of the first transporting unit or to enter the second portion of the first path in response to operation of the second transporting unit) in dependency on the ratio of articles supplied by the producing machine to the requirements of the consuming machine.

The operating means preferably includes means for monitoring the quantity of articles in the magazine and a valve or analogous means for actuating the switching means to respectively direct articles into the first and second inlet when the quantity of articles in the magazine respectively increases to and drops below a predetermined value (most preferably when the magazine is respectively filled to capacity and is only partly filled with articles).

The apparatus preferably further comprises adjustable prime mover means (e.g., a variable-speed motor) for the producing machine, photoelectric cells or analogous means for monitoring the quantity of articles in the magazine, means for monitoring the quantity of articles in the reservoir, and control means (e.g., suitable electronic circuits) which is operative to actuate the second transporting unit in dependency on the quantity of articles in the magazine when the quantity of articles in the reservoir is within a first range and to adjust the prime mover means for the consuming machine in dependency on the quantity of articles in the magazine when the quantity of articles in the reservoir is within a second range.

The third transporting unit, or a conveyor between the switching means and the producing machine, preferably defines or comprises an observation station which allows for visual inspection of articles in the second path or in a third path between the switching means and the producing machine. Such observation station is preferably provided at a locus where a single row of articles is converted into a multi-layer stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
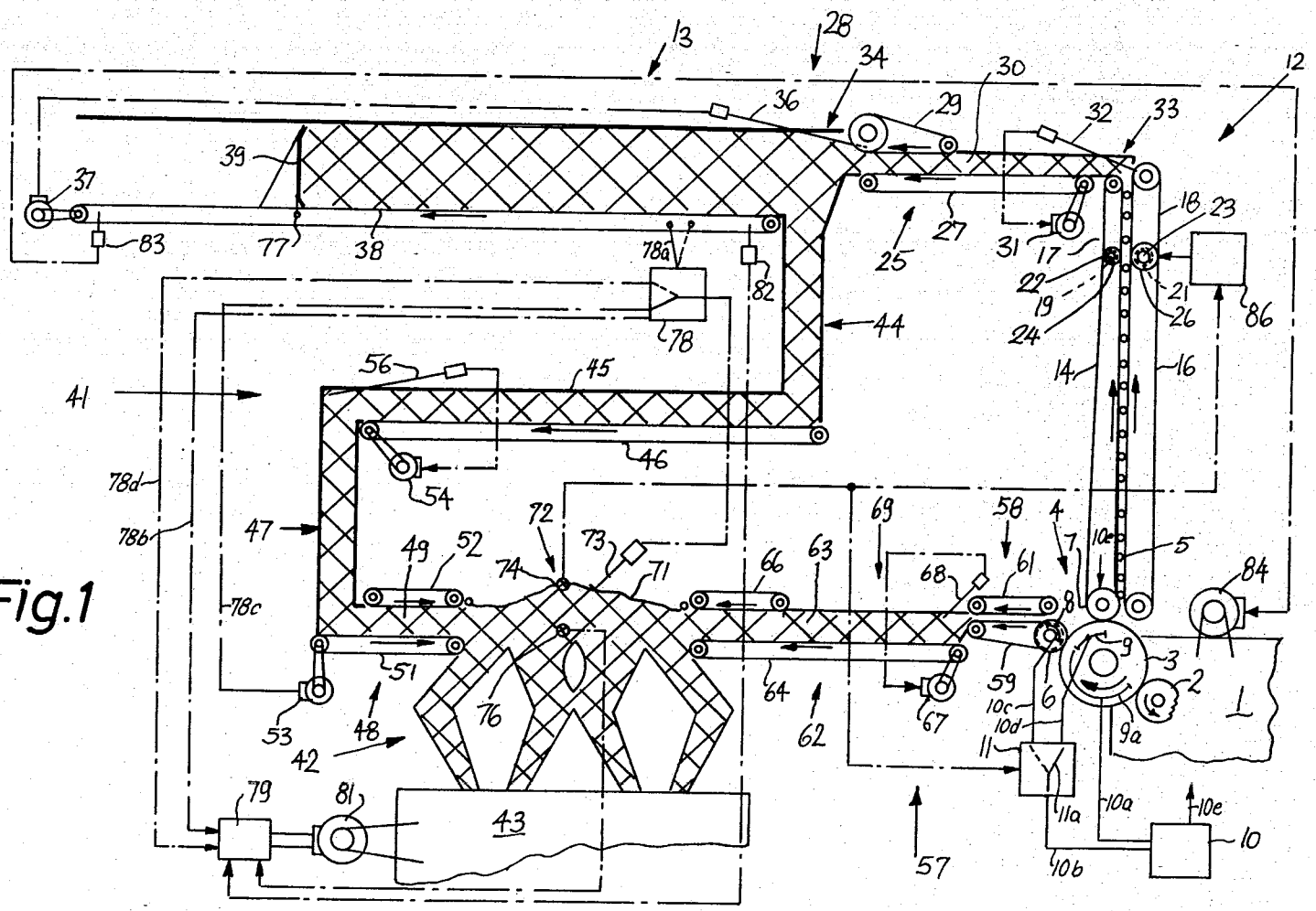
FIG. 1 is a schematic elevational view of an apparatus which embodies one form of the invention and wherein the inlet of each path receives a single layer of rod-shaped articles.

Referring first to FIG. 1, there is shown an apparatus which transports filter cigarettes 5 from a producing machine or maker 1 to a consuming machine 43 (e.g., a packing machine). The producing machine 1 (e.g., a filter tipping machine of the type known as MAX S produced by Hauni-Werke Körber & Co. KG, Hamburg, Federal Republic Germany) has a rotary drum-shaped conveyor 2 which is provided with peripheral flutes serving to deliver a single row of cigarettes 5 sideways into the flutes of a second rotary drum-shaped conveyor 3 forming part of and located at the inlet of a switching unit 4 which is designed to admit cigarettes into the inlet of a first path whose outlet communicates with the left-hand side of a magazine 42 forming part of the consuming machine 43, or into the inlet of a second path whose outlet communicates with the right-hand side of the magazine 42. The swtiching unit 4 further comprises two additional rotary drum-shaped conveyors 6 and 7 which are respectively located at the second and first outlets of the switching unit and each of which has peripheral flutes (not specifically shown) for sidewise transport of cigarettes 5. The flutes of the conveyors 3, 6 and 7 communicate with suction ports which are machined into the respective conveyors and can be connected with a suction generating device 10 (e.g., a fan) through the medium of a two-way solenoid-operated valve 11. The valve 11 can actuate the switching unit 4 to direct cigarettes 5 into the first or second path. Those flutes of the conveyor 3 which travel from the five o'clock to the ten o'clock position (see the arc 9*a*) are in permanent communication with the intake of the suction generating device 10 via conduit 10*a* so that the conveyor 3 invariably accepts the cigarettes 5 which are delivered by the conveyor 2. When the valving element 11*a* of the valve 11 assumes the broken-line position of FIG. 1, the suction ports of the conveyor 6 communicate with the intake of the suction generating device 10 via conduits 10*b*, 10*c* (in the region denoted by the arc 8) so that the flutes of the conveyor 6 accept successive cigarettes 5 from the flutes of the conveyor 3. When the valving element 11*a* is caused to move to the solid-line position of FIG. 1, the flutes of the conveyor 3 communicate with the suction generating device 10 during movement from the five to the ten o'clock position (via conduit 10*a*) and also during movement from the ten to the twelve o'clock position (see the arc 9) via conduits 10*b* and 10*d*. The flutes of the conveyor 6 are then disconnected from the suction generating device 10 and the cigarettes 5 which are transported by the conveyor 3 are admitted into successive flutes of the conveyor 7. The suction ports of the conveyor 7 can be permanently connected to the suction generating device 10 (via conduit 10*e*) or to a separate suction generating device, not shown.

The cigarettes 5 enter into and advance along the first path in the solid-line position of the valving element 11*a*, and the cigarettes enter into and advance along the second path in the broken-line position of the element 11*a*.

The first path is defined by first advancing means including a first transporting unit 12, a horizontal variable-capacity reservoir 13 of the type known as surge bin, and a second transporting unit 41. The second path is defined by advancing means including a further (third) transporting unit 47. The first transporting unit 12 receives a single row of cigarettes 5 from the respective outlet of the switching device 4 (when the valving element 11*a* assumes the solid-line position) and includes two pairs of endless conveyor belts 14, 16 and 17, 18. These belts define a vertical section of a first portion of the first path wherein the cigarettes 5 travel upwardly. The upper pulley 24 for the belt 14 is coaxial with the lower pulley 22 for the belt 17, and these pulleys can be coupled to each other in response to energization of an electromagnetic clutch 19. Analogously, the coaxial pulleys 26, 23 of the belts 16 and 18 can be coupled to each other in response to energization of a second electromagnetic clutch 21. The transporting unit 12 further comprises a conveyor 25 including two endless conveyor belts 27, 29 which define a horizontal section of the first portion of the first path and are located immediately upstream of the surge bin 13. The station or junction where the cigarettes 5 enter the surge bin 13 or merely pass along the left-hand portion of the surge bin on their way toward the second transporting unit 41 is shown at 28. The single row of discrete cigarettes 5 between the belts 14, 16 and 17, 18 is converted into a multi-layer stream 30 on the upper reach of the conveyor belt 27 so that the station or junction 28 receives a continuous body of rod-shaped articles whose height is a multiple of the diameter of a single cigarette.

The belts 27 and 29 of the conveyor 25 are driven by a prime mover here shown as a rotary electromagnet 31 which is in circuit with a pivotable level monitoring sensor 32 at a stream-forming station 33 immediately above the vertical section of the first portion of the first path. The sensor 32 energizes the electromagnet 31 when the height of the piled-up cigarettes 5 therebelow is sufficient to insure the formation of a stream 30 which contains a desired number of layers. Otherwise stated, the sensor 32 insures that the height of the stream 30 in the space between the conveyor belts 27 and 29 is constant or substantially constant.

The cigarettes 5 which reach the junction or station 28 pile up, as at 34, and their top layer bears against a pivotable level monitoring sensor 36 in circuit with a rotary electromagnet 37 for the mobile bottom wall 38 of the surge bin 13. The bottom wall 38 is an endless conveyor belt and its upper reach is connected with an end wall 39 which is movable toward or away from the junction or station 28, depending upon the angular position of the sensor 36. When the sensor 36 pivots counterclockwise, as viewed in FIG. 1, the electromagnet 37 causes the end wall 39 to move in a direction to the left and to thus increase the volume of the surge bin 13. Inversely, the end wall 39 moves in the opposite direction to reduce the capacity of the surge bin 13 when the sensor 36 is permitted to pivot clockwise. This insures that the height of the pile 34 in the junction 28 is substantially constant.

The second transporting unit 41 comprises a first conveyor which is a vertical duct 44 whose inlet is located directly below the junction 28 and whose outlet discharges a vertical multi-layer stream of cigarettes 5 onto the upper reach of a conveyor belt 46 driven by a rotary electromagnet 54 in response to signals from a monitoring means or sensor 56 which overlies the cigarette stream at the discharge end of the belt 46. The latter transports the stream in the space below a stationary top wall 45. The belt 46 discharges cigarettes 5 into a vertical conveyor here shown as a duct 47 which, in turn, delivers the cigarettes to a composite conveyor 48 including an upper endless belt 52 and a lower endless belt 51. The belts 51 and 52 are driven by a rotary electromagnet 53 which receives signals from a selector circuit 78.

If the entire surge bin 13 is shifted to the left, as viewed in FIG. 1, and the conveyor belt 27 is sufficiently long to extend to a locus above the conveyor 48, the ducts 44, 47 and conveyor belt 46 can be replaced with a single duct (see the duct 144 of FIG. 2) which delivers cigarettes 5 from the junction 28 directly to the upper reach of the belt 51.

The transporting unit 57 of the advancing means which defines the shorter second path for direct delivery of cigarettes 5 from the producing machine 1 to the right-hand side of the magazine 42 of the consuming machine 43 comprises a first composite conveyor 58 including an upper endless belt 61 and a lower endless belt 59, and a second composite conveyor 62 including an upper endless belt 66 and a lower endless belt 64. The width of the gap between the belts 59, 61 is slightly less than the diameter of a cigarette 5; these belts advance a single layer or row of cigarettes from the corresponding outlet of the switching device 4 onto the upper reach of the belt 64 when the valving element **11*a* is moved to the broken-line position of FIG. 1. The right-hand pulley for the belt 59 is coaxial with or forms part of the drum-shaped conveyor 6. Due to the aforementioned width of the gap between the belts 59 and 61, these belts positively engage and advance the cigarettes 5 toward a combined collecting and observation station 69 where the single row of cigarettes is converted into a multilayer stream 63 which thereupon enters the space between the belts 64 and 66. The station 69 enables an attendant to observe the progress of cigarettes, and the attendant can remove those cigarettes whose defects are discernible with the naked eye. The speed of the belts 64, 66 is a fraction of the speed of belts 59, 61; this causes the conversion of a single row of cigarettes into a multilayer stream 63. The means for driving the belts 64, 66 includes a rotary electromagnet 67 which is controlled by a sensor 68 mounted at the observation station 69 and serving to monitor the upper level of the stream 63 immediately downstream of the conveyor 58. The length of the upper belt 66 of the conveyor 62 is only a fraction of the length of the lower belt 64 so as to insure that conversion of the single row of cigarettes into the stream 63 can be readily seen and also that the attendant will be in a position to remove samples of articles or to remove defective articles before they reach the belt 66. The sensor 68 insures that, when the belts 64 and 66 are in motion, the magazine 42 of the consuming machine 43 receives cigarettes at a constant rate. The sensor 68 further prevents an interruption of the stream 63, i.e., it arrests the conveyor 62 when the station 69 is not sufficiently filled to insure the formation of a continuous stream 63. Still further, the sensor 68 prevents excessive compacting of cigarettes at the station 69**.

The magazine 42 comprises a flexible cover or membrane 71 which overlies the cigarettes 5 therein. The quantity of cigarettes in the magazine 42 is monitored by two level detectors 72 and 73. The level detector 72 comprises two photoelectric cells 74 and 76 which respectively furnish signals when the magazine 42 is filled to capacity and when the quantity of cigarettes in the magazine has been depleted to a predetermined minimum level. The signals which are furnished by the transducer of the upper cell 74 are used to actuate the valve 11, i.e., to determine whether the magazine 42 will receive cigarettes 5 along the first or along the second path.

The level detector 73 is a sensor which rests on the uppermost layer of cigarettes in the magazine 42 and furnishes signals denoting the degree to which the magazine is filled while the upper level of cigarettes 5 in the magazine is somewhere between the levels of the cells 74 and 76. The arrangement is such that the sensor 73 furnishes a first series of (positive) signals when the upper level of the supply of cigarettes 5 in the magazine 42 is between the maximum level (cell 74) and a predetermined intermediate level, and a second series of (negative) signals when the upper level of such supply is between the intermediate level and the lowest permissible level (cell 76).

The upper reach of the bottom wall 38 of the surge bin 13 carries a trip 77 which actuates a first limit switch 83 when the surge bin is filled to capacity and a second limit switch 82 when the surge bin is empty. The trip 77 further actuates the aforementioned selector circuit 78 when the surge bin 13 is partially filled with cigarettes. To this end, the circuit 78 comprises a movable portion **78*a* which extends into the path of movement of the trip 77. The portion 78*a* can be said to monitor the quantity of cigarettes 5 in the surge bin 13; when this portion assumes the solid-line position, the quantity of cigarettes is within a first range (the surge bin is filled to a greater extent) and the quantity of cigarettes is within a second range (the surge bin is filled to a lesser extent) when the portion 78***a* assumes the broken-line position. The circuit 78 can connect the sensor 73 with the rotary electromagnet 53 for the belts 51, 52 of the conveyor 48 via conductor means 78*c* so that the sensor 73 can effect starting or stoppage of the electromagnet 53, or with a control unit 79 for the adjustable prime mover 81 (e.g., a variable-speed electric motor) of the consuming machine 43 via conductor means 78*b*. The sensor 73 then regulates the speed of the prime mover 81. When the trip 77 moves in a direction to the left and engages the portion 78*a*, the circuit 78 transmits a signal to the control unit 79 via conductor means 78*d* to increase the speed of the prime mover 81 because the surge bin 13 is in the process of being filled, i.e., the magazine 42 cannot accept all of the cigarettes (if any) which are delivered along the first path. The arrangement may be such that, when the circuit 78 transmits a signal via conductor means 78*d*, the prime mover 81 drives the consuming machine 43 at a maximum speed at which the requirements of the consuming machine exceed the output of the producing machine 1 (e.g., by 10 percent). When the control unit 79 receives signals from the sensor 73 via conductor means 78*b* (such situation arises when the trip 77 is located between the portion 78*a* and the limit switch 82), the requirements of the consuming machine 43 deviate only slightly from the output of the machine 1, e.g., within a range of minus $2\frac{1}{2}$ to plus $1\frac{1}{2}$ percent (depending on the angular position of the sensor 73). When the transducer of the lower cell 76 transmits a signal to the control unit 79, the latter arrests the prime mover 81. The prime mover 81 is started in response to disappearance of signal at the output of the transducer of cell 76.

A signal from the limit switch 83 results in stoppage of the prime mover 84 for the consuming machine 1, i.e., the machine 1 is arrested when the surge bin 13 is filled to capacity. When the trip 77 reaches and actuates the limit switch 82 (i.e., when the surge bin 13 is empty), the switch 82 causes the control unit 79 to arrest the prime mover 81 for the consuming machine 43.

The cell 74 of the monitoring device 72 is further connected with a control circuit 86 for the clutches 19 and 21. The circuit 86 includes a suitable time-delay device which disengages the clutches after elapse of a certain interval following reception of a signal from the cell 74.

The operation:

FIG. 1 shows that the surge bin 13 is nearly filled. Such situation will arise when the consuming machine 43 is idle, e.g., due to a malfunction which is expected to be eliminated within a relatively short interval of time. The magazine 42 of the consuming machine 43 is filled to capacity; therefore, the cell 74 of the level detector 72 transmits to the valve 11 a signal of first intensity (e.g., a zero signal) whereby the valving element 11*a* is held in the solid-line position so that the conveyor 3 delivers cigarettes 5 into the first path by way of the flutes of the conveyor 7. The clutches 19 and 21 are energized so that the belts 14, 16 and 17, 18 move at the same speed and advance a single row of cigarettes upwardly to the stream forming station 33. Such single row of cigarettes 5 is converted into the multi-layer stream 30 and the stream 30 is fed to the junction 28 at the rate determined by the sensor 32 which controls the rotary electromagnet 31. The pile 34 of cigarettes 5 in the junction 28 is monitored by the sensor 36 which controls the rotary electromagnet 37 for the bottom wall 38 and end wall 39 of the surge bin 13. The end wall 39 moves away from the junction 28 because the magazine 42 is filled to capacity and the transporting unit 12 continues to deliver cigarettes 5 to the pile 34.

If the elimination of the cause of malfunction in the consuming machine 43 takes up a relatively long interval of time, the surge bin 13 is completely filled and the trip 77 reaches and actuates the limit switch 83 which arrests the prime mover 84 for the producing machine 1. If the cause of malfunction is eliminated before the trip 77 actuates the limit switch 83, the quantity of cigarettes in the magazine 42 begins to decrease. This is detected by the sensor 73 which causes the selector circuit 78 to transmit a signal via conductor means 78*d* so that the speed of the prime mover 81 for the consuming machine 43 is increased to the maximum speed. The speed of the machine 43 is then such that its requirements exceed the output of the producing machine 1 by ten percent. The upper level of cigarettes in the magazine 42 rapidly sinks below the cell 74 whose transducer transmits a signal to the valve 11 so that the latter moves the valving element 11*a* to the broken-line position and the conveyor 3 begins to deliver cigarettes into the second path, i.e., into the space between the belts 59, 61 of the conveyor 58 in the transporting unit 57. The cigarettes which form a single row between the belts 59, 61 are caused to form a multi-layer stream 63 on the upper reach of the belt 64, and such stream is admitted into the right-hand portion of the magazine 42. The uniformity of the stream 63 is insured due to the provision of sensor 68 which controls the prime mover 67 for the belts 64, 66 of the conveyor 62.

The cell 74 further transmits a signal to the control circuit 86 which disengages the clutches 19, 21 after elapse of a certain interval of time which is necessary to insure that all cigarettes 5 which were located between the conveyor belts 14, 16 are advanced beyond the upper ends of these belts before the clutches 19 and 21 are disengaged.

The cigarettes 5 which are fed to the magazine 42 by transporting unit 57 do not suffice to meet the requirements of the consuming machine 43 because the prime mover 81 continues to drive this machine at the maximum speed at which the requirements of the machine 43 exceed the output of the producing machine 1 by ten percent. Therefore, the upper level of cigarettes 5 in the magazine 42 continues to sink. The membrane 71 follows the downward movement of the uppermost layer of cigarettes in the magazine 42 and pivots the sensor 73 in a counterclockwise direction. When the sensor 73 reaches a predetermined angular position at the lower end of its regulating range, it transmits a signal to the selector circuit 78 which starts the electromagnet 53 via conductor means 78*c* and causes the belts 51, 52 of the conveyor 48 to feed a multi-layer stream 49 of cigarettes into the left-hand portion of the magazine 42. The electromagnet 53 arrests the belts 49, 51 when the upper level of the supply in the magazine 42 rises to a level at which the selector circuit 78 ceases to transmit signals to the electromagnet 53, i.e., the tranporting unit 41 is on or off, depending on the degree of filling of the magazine 42. Such mode of operation insures that the magazine 42 is always filled to a certain degree (within the range of regulation by the pivotable sensor 73). The transporting unit 41 receives cigarettes 5 from the surge bin 13, i.e., the sensor 56 starts the electromagnet 54 for the belt 46 when the pressure of cigarettes against its underside drops below a predetermined minimum value, and the sensor 36 starts the electromagnet 37 when the pressure of the pile 34 against its underside drops below a certain value. When the trip 77 (which moves in a direction to the right) reaches and engages the portion 78*a*, the selector circuit 78 causes the control unit 79 to reduce the speed of the prime mover 81 and the circuit 78 connects the control unit 79 with the sensor 73. Consequently, the speed of the prime mover 81 begins to vary in dependency on changes in angular position of the sensor 73 which maintains the requirements of the consuming machine 43 within a range between plus 2½ and minus 2½ percent of the output of the producing machine 1.

If a further malfunction of the consuming machine 43 causes renewed filling of the magazine 42 to the level which is determined by the position of the upper cell 74, the transducer of the cell 74 ceases to transmit a signal to the valve 11 so that the valving element 11*a* returns to the solid-line position and the conveyor 3 delivers cigarettes 5 into the first path. Also, the signal from the transducer of the cell 74 (or more particularly the absence of such signal) causes the control circuit 86 to immediately engage the clutches 19, 21 so that the belts 14, 16 are set in motion and advance the cigarettes 5 into the space between the belts 17, 18. The single row of cigarettes is converted into a layer 30 which is thereupon admitted into the surge bin 13 whose end wall 39 moves in a direction to the left.

If the producing machine 1 is arrested or is out of commission, the sensor 68 detects the absence of delivery of articles to the observation station 69 and transmits a signal which causes the electromagnet 67 to arrest the belts 64 and 66. The quantity of cigarettes in the magazine 42 decreases and, when the transducer of the cell 76 is free to transmit a signal, the control unit 79 arrests the prime mover 81 for the consuming machine. If the cause of malfunction of the producing machine 1 is eliminated, cigarettes 5 begin to advance along the second path (transporting unit 57) and the attendant is in a position to observe the accumulation of articles at the station 69 as well as to remove samples for visual examination of their quality. Also, the attendant can remove all defective cigarettes which can be discovered by looking at the stream 63 at the station 69. Samples of articles can also be removed from the first path (e.g., from the surge bin 13) during normal operation of the apparatus, i.e., when the cigarettes 5 are transported by the unit 57 from the producing machine 1 directly into the magazine 42. The removal of some or even a large number of cigarettes from the second path does not affect the operation, especially since the total number of cigarettes in the second path is relatively small (when compared with the output of a high-speed producing machine which can turn out up to and in excess of 70 articles per second).

If desired, the selector circuit 78 can be installed at another locus, e.g., substantially midway between the ends of the surge bin 13. This insures that the consuming machine 43 can receive cigarettes from the surge bin for a relatively long period of time after the producing machine 1 is arrested. It is further possible to provide additional or supplemental controls for the prime movers of the producing and consuming machines; such supplemental controls can change the speed of the prime mover 81 and/or 84 in dependency on the extent to which the surge bin 13 is filled with cigarettes. For example, the additional controls may include means for causing the prime mover 81 to drive the consuming machine 43 at a greatly reduced speed when the prime mover 84 is arrested so that the machine 43 can operate for a relatively long interval of time following complete stoppage of the producing machine 1 (or vice versa).

Since the outlet of the first path (defined by the transporting units 12, 41 and a portion of the surge bin 13) communicates with the left-hand side of the magazine 42, and the outlet of the second path (defined by the transporting unit 57) communicates with the right-hand side of the magazine 42, the cigarettes 5 which are delivered along the first path cannot interfere with entry of cigarettes which are delivered along the second path, or vice versa. The apparatus need not be provided with numerous and complex switching and blocking mechanisms for the cigarettes in the first or second path. This reduces the likelihood of deformation of and/or other damage to the cigarettes. Moreover, by reducing the number of and/or eliminating the just mentioned devices, the apparatus is simpler and therefore less prone to malfunction. The means which actuates the switching unit 4 is also simple and comprises a small number of parts. All that is actually necessary is to monitor the quantity of cigarettes in the magazine 42 and to automatically cause the switching unit 4 to deliver cigarettes into the adjacent inlet of the first or second path in dependency on the quantity of cigarettes in the magazine 42, i.e., whether or not the magazine 42 is completely filled.

The aforementioned devices which change the requirements of the consuming machine 43 (i.e., the speed of the prime mover 81) in dependency on the degree to which the surge bin 13 is filled with cigarettes are also relatively simple. These devices include the sensor 73, the portion 78*a* of the selector circuit 78, the control unit 79 and the limit switch 82. Depending on the degree to which the surge bin 13 is filled with cigarettes, the sensor 73 activates or deactivates the transporting unit 57 and/or changes the speed of the prime mover 81.

The provision of the observation station 69 is particularly important during the period immediately following starting of the producing machine 1. A skilled attendant can readily determine whether or not the cigarettes 5 which are furnished by the belts 59, 61 immediately after starting of the machine 1 are acceptable. Such attendant will observe the quality of the seam of the wrapper of a filter cigarette, the manner in which the uniting band is rolled around the filter plug and around the adjacent inner end of the tobacco-containing portion of the cigarette, and/or the position and quality of printed matter on the wrapper. Since the cigarettes which are produced immediately after starting of the machine 1 are normally admitted into the second path, it is sufficient to provide the observation station at a locus which is adjacent to the second path. This station preferably permits for inspection of cigarettes 5 from above and is preferably located immediately downstream of the point where the transport of a single layer or row of cigarettes ends, i.e., immediately downstream of the conveyor 58 in the transporting unit 57.

The placing of the observation station 69 immediately downstream of the conveyor 58 is advantageous and desirable on the additional ground that the speed of cigarettes 5 on the belt 64 is a small fraction of the speed of cigarettes between the belts 59, 61. This enables the attendant or attendants to readily discern the condition of cigarettes which are produced immediately after starting of the producing machine 1 as well as during normal operation of the machines 1 and 43. The attendant or attendants can remove samples by hand and can place the removed samples back onto the top layer of the stream 63 if the samples are satisfactory. As mentioned above, the producing machine 1 can turn out up to and in excess of 70 cigarettes per second so that the removal of samples from a single row of cigarettes moving at a speed which is required for evacuation of up to and in excess of 4,000 cigarettes per minute would present problems and the attendant would be likely to change the orientation of cigarettes which precede or immediately follow the removed cigarette or cigarettes. The placing of observation station 69 close to the producing machine 1 is desirable on the additional ground that an attendant, who has discovered that the cigarettes on the belt 64 are unsatisfactory, can immediately reach the controls in order to stop the prime mover 84 or to reduce its speed so as to allow for more detailed observation of a certain number of cigarettes which issue from the machine 1.

Figure 2:
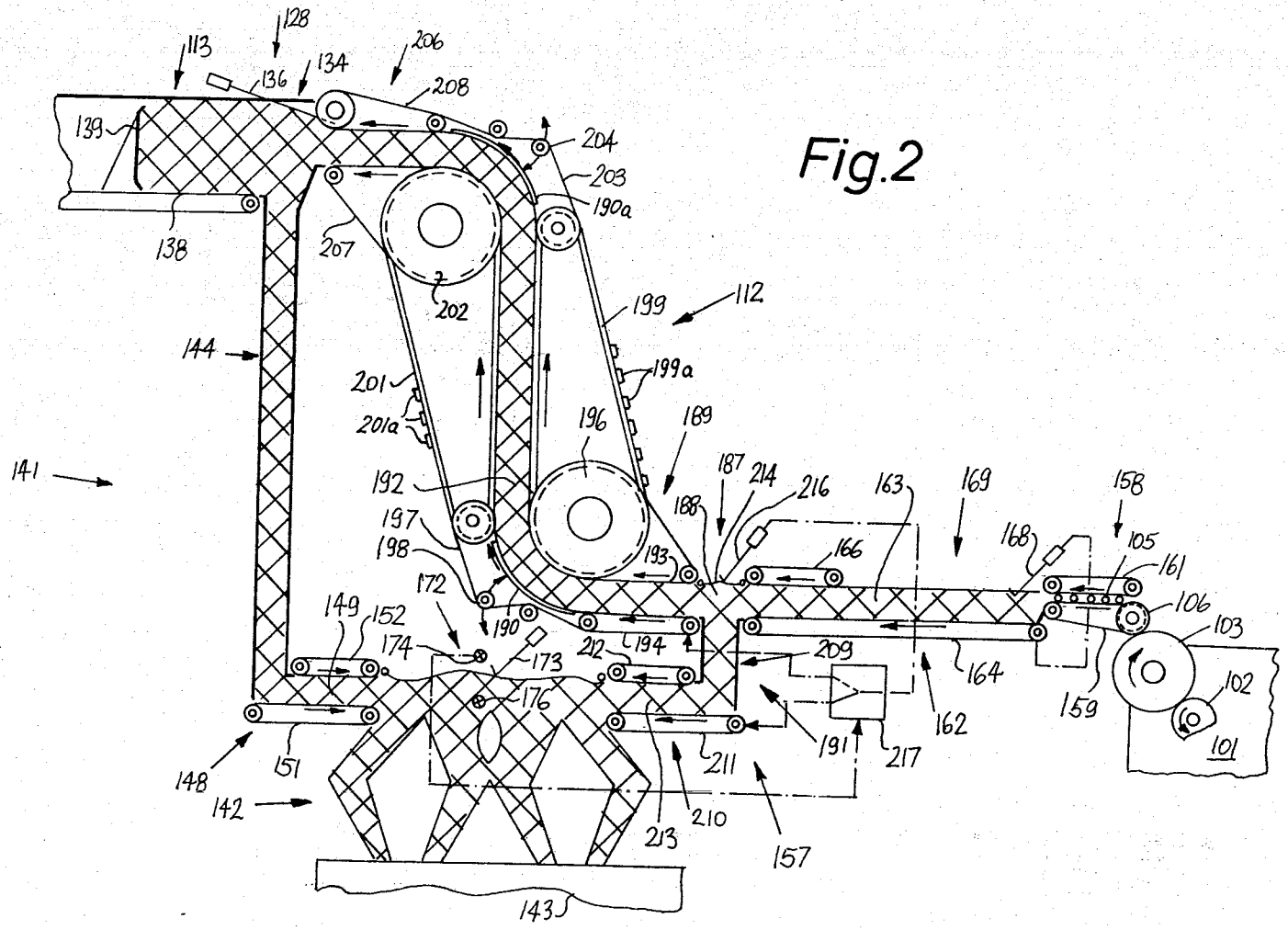
FIG. 2 is a similar schematic elevational view of a second apparatus wherein the inlet of each path receives a multilayer stream of articles.

FIG. 2 shows a portion of a modified apparatus. All such parts of the apparatus of FIG. 2 which are identical with or clearly analogous to corresponding parts of the apparatus of FIG. 1 are denoted by similar reference characters plus 100. Furthermore, all control units and rotary electromagnets which are used in the apparatus of FIG. 2 and are identical with those shown in and described in connection with FIG. 1 have been omitted in FIG. 2 for the sake of clarity.

The main difference between the apparatus of FIGS. 1 and 2 is that the apparatus of FIG. 2 forms a multi-layer stream 163 ahead of the switching station where the cigarettes 105 (or analogous rod-shaped articles which constitute or form part of smokers' products) enter the first or the second path on their way toward the magazine 142 of the consuming machine 143. Thus, the switching unit 187 is located downstream of the observation station 169 where the upper layer of the stream 163 can be inspected by an attendant. The conveyor 103 of the producing machine 101 delivers a single row of cigarettes 105 into the space between the belts 159, 161 of the conveyor 158, and such single row is converted into the stream 163 on the upper reach of the belt 164 forming part of the conveyor 162.

The switching unit 187 includes a junction 188 where the upper layer of the pile of cigarettes 105 is overlapped by a membrane 214 and is contacted by a monitoring means or sensor 216. Such cigarettes are delivered by the belts 164, 166 of the conveyor 162. The branch 189 of the junction 188 leads to the first path which is defined by the first transporting unit 112, by the surge bin 113 and by the second transporting unit 141. The branch 189 is horizontal and defines a continuation of the path defined by the conveyor 162. A second branch 191 of the junction 188 is vertical and delivers cigarettes 105 downwardly to the transporting unit 157 which defines the relatively short second path for delivery of cigarettes to the right-hand side of the magazine 142.

The branch 189 includes two endless belts 193, 194 which cooperate with a further endless belt 197 to change the orientation of the multi-layer stream 192 between the belts 193, 194 so that the stream moves vertically upwardly and enters the intake end of that portion of the first path which is defined by the transporting unit 112. The upper belt 193 is trained over a small pulley and a larger pulley or drum 196 located opposite the belt 197. That reach of the belt 197 which does not engage the stream 192 is tensioned by a spring-biased roll 198 mounted in the frame of the apparatus for movement in directions indicated by the double-headed arrow. The article-engaging reach of the belt 197 can be caused to move along the concave side of a suitable configurated guide 190.

The transporting unit 112 comprises two endless conveyor belts 199, 201 defining the vertical first portion of the first path. The lower end of the belt 199 is trained over the drum 196 and the upper end of the belt 201 is trained over a similar drum 202. The outer sides of the belts 199, 201 are preferably provided with cushions consisting of foamed synthetic plastic material and/or with transversely extending entraining projections **199*a*, 201*a* in the form of ribs or the like. The cushions and/or projections 199*a*, 201*a* insure predictable upward movement of the stream 192 between the belts 199, 201. The belt 199 of the transporting unit 112 is followed by an endless conveyor belt 203 which is analogous to the belt 197 and is tensioned by a spring-biased roll 204. That reach of the belt 203 which contacts the stream 192 can be caused to travel below the concave side of a suitably configurated guide 190*a* corresponding to the guide 90. A conveyor 206 of the transporting unit 112 includes two endless belts 207, 208 which correspond to the belts 27, 29 of the conveyor 25 shown in FIG. 1**.

The transporting unit 141 comprises a single vertical conveyor or duct 144 whose upper end is located directly below the station 128 and whose lower end discharges a stream of cigarettes 105 onto the lower belt 151 of the conveyor 148.

The third transporting unit 157 receives a stream of cigarettes 105 from the branch 191 of the junction 188 and includes a vertical conveyor duct 209 and a horizontal conveyor 210 including two endless belts 211 and 212. The stream 213 which is transported by the unit 157 enters into the right-hand portion of the magazine 142. The stream 149 which is delivered by the belts 151, 152 of the conveyor 148 in the transporting unit 141 enters the left-hand portion of the magazine 142.

The aforementioned sensor 216 at the junction 188 transmits signals to an electronic valve 217 which further receives signals from the transducer of the upper photoelectric cell 174 and transmits signals to the driving pulley for the belts 193, 194, 197, 199, 201, 203, 207, 208 or to the driving pulley for the belts 211, 212. The sensor 216 can be connected with the membrane 214 so that it shares the movements of the membrane in response to rise or fall of the pile of cigarettes in the junction 188.

The operation of the apparatus of FIG. 2 is similar to that of the apparatus which is shown in FIG. 1. The cigarettes 105 which form a single row at the outlet (conveyors 102 and 103) of the producing machine 101 are converted into a multi-layer stream 163 at the observation station 169, and such stream advances to the junction 188. This means that the apparatus of FIG. 2 permits for observation of articles 105 before they enter the first or the second path (in FIG. 1, only the articles which enter the second path can be observed with the naked eye). The cell 174 in the magazine 142 transmits signals to the valve 217 and such signals serve to direct articles into the first or into the second path. Thus, when the transducer of the cell 174 ceases to transmit a signal to thus indicate that the magazine 142 is filled to capacity, the valve 217 enables the sensor 216 to regulate the movements of the belts 193, 194 and the belts of the transporting unit 112 in dependency on the height of the pile of cigarettes 105 in the junction 188. If the magazine 142 is not filled to capacity so that the valve 217 receives a signal from the transducer of the cell 174, the sensor 214 regulates the movements of the belts 211, 212 in the third transporting unit 157. As described in connection with FIG. 1, the transporting unit 157 begins to deliver articles to the magazine 142 upon at least partial evacuation of the contents of the surge bin 113 following the descent of the supply of cigarettes 105 in the magazine 142 below the level of the cel 174. This insures that, when the transporting unit 112 is started again, there is room in the surge bin 113 for reception of articles while the magazine 142 is filled to capacity.

An important advantage of the improved apparatus is that the magazine 42 or 142 can receive multi-layer streams of rod-shaped articles from one side or from the other side so that the stream which is delivered along the first path cannot interfere with the stream which is delivered along the second path. As mentioned above, the magazine 42 or 142 normally receives articles from the outlet of the path which is defined by the third transporting unit 57 or 157. The outlet of the first path (i.e., the conveyor 48 or 148) delivers articles when the surge bin 13 or 113 is at least partly filled. The switching device 4 or 187 does not affect the quality of the conveyed articles, regardless of whether the articles are transported along the first or along the second path. Furthermore, the apparatus enables one or more attendants to observe the conversion of a single layer or row of articles into a multi-layer stream as well as to observe the quality of articles which issue from the producing machine. This is particulary important during the period immediately following starting of the producing machine. However, a visual quality control can be carried out with equal advantage during normal operation of the apparatus, either continuously or at regular or irregular intervals. This insures that eventual defects of the articles can be detected practically immediately and the attendants can undertake necessary steps to eliminate the cause of defects or to stop the machines in order to prevent introduction of defective articles into packs or other types of receptacles. The apparatus of FIG. 2 exhibits the additional advantage that it allows for inspection of all articles, i.e., the station 169 is located ahead of the locus where the switching unit 187 directs articles into the first or second path.

Reliable inspection of articles prior to entry into the magazine of the consuming machine is desirable and necessary on several grounds. First of all, the purchaser must be satisfied with the quality of each and every smokers' product in a pack. Secondly, defective articles are likely to contaminate the apparatus and/or the consuming machine. Furthermore, defective articles are likely to interfere with orderly transport of satisfactory articles. The improved apparatus not only allows the inspection of articles (as mentioned above, such inspection is particularly important immediately after the producing machine is started) but it also insures that the articles are treated gently, i.e., that the articles are not deformed, defaced or otherwise damaged during transport form the producing machine to the consuming machine regardless of whether the delivery takes place along the first or along the second path.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for delivering streams of cigarettes, filter rod sections or analogous rod-shaped articles from a producing machine to a consuming machine which includes a magazine having a first side and a second side, comprising first advancing means defining a first path having a first inlet and a first outlet, said outlet communicating with one side of said magazine and said advancing means including a first transporting unit which defines a first portion of said path starting at said first inlet, a second transporting unit which defines a second portion of said path ending at said first outlet, and a substantially horizontal variable-capacity reservoir having an open end communicating with said first path intermediate said first and second portions, said first transporting unit including a substantially horizontal conveyor upstream of said reservoir and said second transporting unit including a substantially vertical conveyor downstream of said open end; second advancing means including a third transporting unit defining a second path having a second inlet and a second outlet, said second outlet communicating with the other side of said magazine; switching means interposed between said producing machine and said inlets and operable to direct articles issuing from said producing machine into a selected inlet, including a junction which receives articles from said producing machine and communicates with said first and second paths; means for conveying articles sideways in the region of said switching means including a first conveyor arranged to transport a single row of articles, a second conveyor receiving articles from said first conveyor, means for driving said first conveyor at a first speed and means for driving said second conveyor at a lower second speed so as to effect the conversion of said single row into a multi-layer stream of articles in said second conveyor, said conveyors being disposed between said producing machine and said switching means; means for monitoring the quantity of articles in said magazine; means for monitoring the quantity of articles in said junction; means for operating said switching means to direct articles into said first inlet when the ratio of articles supplied by said producing machine to articles removed by said third transporting unit is above a predetermined value and to direct articles into said second inlet when said ratio drops to said predetermined value, said operating means including means for starting said first transporting unit when the quantity of articles in said magazine and said junction respectively rises to a first and a second predetermined value and for starting said third transporting unit when the quantity of articles in said magazine is below said first value but the quantity of articles in said junction reaches said second value; and means for varying the volume of said reservoir in dependency on the ratio of articles supplied by said producing machine through the first transporting unit to the articles fed to said consuming machine by the second transporting unit.

2. Apparatus as defined in claim 1, further comprising adjustable prime mover means for said producing machine, means for monitoring the quantity of articles in said reservoir, and control means operative to actuate said second transporting unit in dependency on changes in quantity of articles in said magazine when the quantity of articles in said reservoir is within a first range and to adjust said prime mover means in dependency on changes in quantity of articles in said magazine when the quantity of articles in said reservoir is within a second range.

3. Apparatus as defined in claim 1, further comprising an observation station wherein the articles are exposed to view, said observation station being disposed between said producing machine and said junction.

4. Apparatus as defined in claim 1 wherein said conveying means defines an observation station wherein the articles are exposed to view.

5. Apparatus as defined in claim 1, wherein said second conveyor is substantially horizontal and includes a portion wherein said multi-layer stream of articles is observable from above.

6. Apparatus as defined in claim 1, wherein said third transporting unit further comprises a duct having an upper end which receives a multi-layer stream of articles from said switching means and a lower end, and a substantially horizontal conveyor operable to advance said last mentioned multi-layer stream from said lower end to said other side of said magazine.

7. Apparatus as defined in claim 1, wherein said first transporting unit is arranged to transport a multi-layer stream of articles along said first portion of said first path, said first portion of said first path including a section wherein said multi-layer stream is conveyed from a first level to a higher second level.

8. Apparatus as defined in claim 1, wherein said horizontal conveyor and said reservoir define a junction located above said vertical conveyor.

9. Apparatus as defined in claim 1, wherein said second transporting unit includes a duct having an upper end receiving a multi-layer stream of articles issuing from said reservoir and a lower end, and a substantially horizontal conveyor operable to convey said multi-layer stream from said lower end to said one side of said magazine.

10. Apparatus as defined in claim 1, wherein said first transporting unit and said reservoir define a second junction which receives articles from said first transporting unit, said means for varying the volume of said reservoir including means for monitoring the quantity of articles in said second junction and means for respectively increasing and reducing the volume of said reservoir in response to detected increase and reduction of the quantity of articles in said second junction.

* * * * *

UNITED STATES PATENT AND TRADEMARK OFFICE

CERTIFICATE OF CORRECTION

PATENT NO. : 4,339,026

DATED : July 13, 1982

INVENTOR(S) : Horst BÄSE, Gerhard TOLASCH, Jürgen BANTIEN

It is certified that error appears in the above-identified patent and that said Letters Patent are hereby corrected as shown below:

Title page item [30] Foreign Application Priority Data, date should read --June 11, 1976--.
Col. 1, line 31, "bo" should read --to--.
Col. 4, line 45, "47" should read --57--.
Col. 13, line 14, "cel" should read --cell--.

Signed and Sealed this

Seventh Day of June 1983

[SEAL]

Attest:

DONALD J. QUIGG

Attesting Officer

Acting Commissioner of Patents and Trademark